US012660855B2

(12) United States Patent
Peng et al.

(10) Patent No.: US 12,660,855 B2
(45) Date of Patent: Jun. 23, 2026

(54) ATOMIZATION CORE

(71) Applicant: Shanghai QV Technologies Co., Ltd., Shanghai (CN)

(72) Inventors: Xiaofeng Peng, Oakville (CA); Qiwen Peng, Oakville (CA)

(73) Assignee: Shanghai QV Technologies Co., Ltd., Shanghai (CN)

( * ) Notice: Subject to any disclaimer, the term of this patent is extended or adjusted under 35 U.S.C. 154(b) by 802 days.

(21) Appl. No.: 17/572,315

(22) Filed: Jan. 10, 2022

(65) Prior Publication Data

US 2022/0125113 A1 Apr. 28, 2022

Related U.S. Application Data

(63) Continuation of application No. PCT/CN2020/088397, filed on Apr. 30, 2020.

(30) Foreign Application Priority Data

Aug. 13, 2019 (CN) ..... 201910742101.9

(51) Int. Cl.

| | |
|---|---|
| ***A24F 40/46*** | (2020.01) |
| ***A24F 40/20*** | (2020.01) |
| ***A24F 40/44*** | (2020.01) |

(52) U.S. Cl.

CPC ..... *A24F 40/46* (2020.01); *A24F 40/20* (2020.01); *A24F 40/44* (2020.01)

(58) Field of Classification Search

CPC ..... A24F 40/20; A24F 40/44; A24F 40/46

See application file for complete search history.

(56) References Cited

U.S. PATENT DOCUMENTS

| | | | |
|---|---|---|---|
| 4,588,540 | A | 5/1986 | Kiefer et al. |
| 4,647,477 | A | 3/1987 | DeLuca |
| 6,126,723 | A | 10/2000 | Drost et al. |
| 7,920,777 | B2 | 4/2011 | Rabin et al. |
| 8,881,737 | B2 | 11/2014 | Collett et al. |

(Continued)

FOREIGN PATENT DOCUMENTS

| | | | |
|---|---|---|---|
| CN | 201519640 | U | 7/2010 |
| CN | 102256386 | A | 11/2011 |

(Continued)

OTHER PUBLICATIONS

IEC 60050—International Electrotechnical Vocabulary—Details for IEV No. 523-05-02: "thin film technology" (Year: 2018).*

(Continued)

*Primary Examiner* — Katherine A Will

(74) *Attorney, Agent, or Firm* — Manelli Selter PLLC; Edward Stemberger

(57) ABSTRACT

The present disclosure relates to the field of atomization applications. More specifically, the disclosure relates to an atomization core, comprising a core substrate and a heating body on the core substrate, wherein the core substrate is made of a dense material (e.g., dense ceramics), with e-liquid transferring perforations distributed in the substrate; the diameter of the e-liquid transferring perforations is 1-250 μm; the wall spacing between two adjacent e-liquid transferring perforations is less than 500 μm; and the porosity of the dense material is less than 30%.

20 Claims, 6 Drawing Sheets

(56) References Cited

U.S. PATENT DOCUMENTS

| | | | | |
|---|---|---|---|---|
| 9,861,132 | B2 | 1/2018 | Li et al. | |
| 9,986,760 | B2 | 6/2018 | Macko et al. | |
| 10,136,672 | B2 | 11/2018 | Minskoff et al. | |
| 10,194,694 | B2 | 2/2019 | Davis et al. | |
| 10,201,185 | B2 | 2/2019 | Bleloch et al. | |
| 10,272,170 | B2 | 4/2019 | Dubief | |
| 10,292,429 | B2 | 5/2019 | Duc et al. | |
| 10,463,077 | B2 | 11/2019 | Lau et al. | |
| 10,548,351 | B2 | 2/2020 | Brammer et al. | |
| 11,078,108 | B2 | 8/2021 | Peuchert et al. | |
| 11,117,068 | B2 | 9/2021 | Meinhart et al. | |
| 11,272,739 | B2 | 3/2022 | Schmidt et al. | |
| 11,458,265 | B2 | 10/2022 | Brammer et al. | |
| 2007/0095507 | A1 | 5/2007 | Henderson et al. | |
| 2012/0161747 | A1 | 6/2012 | Roux | |
| 2014/0060554 | A1* | 3/2014 | Collett | A24F 40/42 392/386 |
| 2015/0114409 | A1 | 4/2015 | Brammer et al. | |
| 2015/0359262 | A1 | 12/2015 | Liu et al. | |
| 2016/0007653 | A1 | 1/2016 | Tu | |
| 2016/0138795 | A1 | 5/2016 | Meinhart et al. | |
| 2017/0105455 | A1 | 4/2017 | Qiu | |
| 2017/0360100 | A1 | 12/2017 | Duc et al. | |
| 2017/0367411 | A1 | 12/2017 | Duc | |
| 2018/0162769 | A1 | 6/2018 | Peuchert et al. | |
| 2018/0360112 | A1 | 12/2018 | Qiu | |
| 2019/0006866 | A1 | 1/2019 | Zhu | |
| 2019/0053539 | A1 | 2/2019 | Davis et al. | |
| 2019/0098935 | A1 | 4/2019 | Phan et al. | |
| 2019/0183180 | A1* | 6/2019 | Rath | A24F 40/46 |
| 2019/0216132 | A1 | 7/2019 | Phan et al. | |
| 2019/0249929 | A1 | 8/2019 | Rush et al. | |
| 2020/0359704 | A1 | 11/2020 | Deng | |
| 2021/0052008 | A1 | 2/2021 | Han et al. | |
| 2021/0112871 | A1* | 4/2021 | Kalaydzhyan | H05B 3/143 |
| 2021/0161207 | A1 | 6/2021 | Li et al. | |
| 2021/0227885 | A1 | 7/2021 | Sudlow et al. | |
| 2022/0117302 | A1 | 4/2022 | Kleine et al. | |
| 2022/0125114 | A1 | 4/2022 | Peng et al. | |
| 2022/0338543 | A1 | 10/2022 | Shi et al. | |
| 2022/0401669 | A1 | 12/2022 | Brammer et al. | |

FOREIGN PATENT DOCUMENTS

| | | | | |
|---|---|---|---|---|
| CN | 106252602 | A | 12/2016 | |
| CN | 107874322 | A | 4/2018 | |
| CN | 108158040 | A | 6/2018 | |
| CN | 205831081 | U | 7/2018 | |
| CN | 108887753 | A | 11/2018 | |
| CN | 109043668 | A | 12/2018 | |
| CN | 109090713 | A | 12/2018 | |
| CN | 109123804 | A | 1/2019 | |
| CN | 109192521 | A | 1/2019 | |
| CN | 109222251 | A | 1/2019 | |
| CN | 109363247 | A | 2/2019 | |
| CN | 109363248 | A | 2/2019 | |
| CN | 109414078 | A | 3/2019 | |
| CN | 109527657 | A | 3/2019 | |
| CN | 109619687 | A | 4/2019 | |
| CN | 208740113 | U | 4/2019 | |
| CN | 109770438 | A | 5/2019 | |
| CN | 109770439 | A | 5/2019 | |
| CN | 109820252 | A | 5/2019 | |
| CN | 109875125 | A | 6/2019 | |
| CN | 110025057 | A | 7/2019 | |
| CN | 110051043 | A | 7/2019 | |
| CN | 110063529 | A | 7/2019 | |
| CN | 110089778 | A | 8/2019 | |
| CN | 111109665 | A | 5/2020 | |
| CN | 210809287 | U | 6/2020 | |
| EP | 0187256 | A1 | 7/1986 | |
| EP | 1250719 | A2 | 10/2002 | |
| RU | 1794614 | C | 2/1993 | |
| RU | 2155729 | C1 | 9/2000 | |
| RU | 2433100 | C2 | 11/2011 | |
| RU | 2018108876 | A | 9/2019 | |
| WO | WO-2015117702 | A1 * | 8/2015 | A24B 15/167 |
| WO | WO-2019239252 | A1 * | 12/2019 | A24F 40/42 |

OTHER PUBLICATIONS

Nov. 17, 2020—(CN) English translation of Search Report—PCT/CN2020/108894.

Madou, Marc. (1997). "Fundamentals of Microfabrication" book.

Jul. 28, 2020—(CN) English translation of Search Report—PCT/CN2020/088397.

* cited by examiner

ATOMIZATION CORE

CROSS-REFERENCES

This application is a continuation application of International Application No. PCT/CN2020/088397, filed Apr. 30, 2020, and entitled "New Type of Vaporization Core," which claims priority to Chinese Application CN 201910742101.9, filed Aug. 13, 2019, and entitled "New Type of Vaporization Core." The contents of all prior applications are hereby incorporated by reference in their entirety.

TECHNICAL FIELD

The disclosure relates to atomization applications. More specifically, the disclosure relates to a novel atomization core.

BACKGROUND

At present, electrical resistance heating is normally employed in e-cigarettes and some medical atomizers to heat liquids to generate aerosol. There are four types in general:

First, glass fiber rope plus heating wire: the most common e-cigarette atomizer generally winds the resistance heating wire on the fiber rope used for transferring the liquid. The glass fiber rope is used as the main transferring material because of its firm selvage, high temperature resistance, strong liquid absorption, and fast transfer speed. However, the biggest disadvantage of glass fiber rope is that it is easy to fall off and produce flocs. Furthermore, when the position of the heating wire is fixed and the heating wire is wound around the fiber rope, the surface of the heating wire is exposed to the outside of the fiber rope, which results in low consistency of the atomizing device, low atomizing efficiency, and dry burning.

Second, cotton plus heating wire: around 2013, cotton began to replace glass fiber rope as the main transferring material. Compared with glass fiber rope, it is safer and delivers a flavor more authentical to that of tobacco through the e-liquid. Its development has gone from absorbent cotton and organic cotton to professional e-cigarette cotton such as highest grade long-staple cotton. At present, cotton plus heating wire is still the mainstream in the market, but sugar in the e-liquid will be adsorbed on the surface of heating wire to form what we usually call carbon deposit, which leads to the darkening of cotton and is also easy to generate harmful and potential harmful constituents (HPHC) in the aerosol.

Third, ceramic atomization core: the development of e-cigarettes has led to the emergence of various transferring materials. Porous ceramic transferring materials have become popular for e-cigarettes. There are mainly two kinds of ceramic atomization cores on the market: one is to embed heating wires in a porous ceramic body, e.g., CCell™; the other is to screen print a layer of conductive heating coating on the porous ceramic, e.g., Feelm™ and Silmo™. The pores of the porous ceramic are dispersed in various sizes, resulting in easily coking or dry burning of some liquid components during vaping, or leakage of liquid due to large perforations. CN20188001973.3 discloses that a 0.5-5 μm thick titanium-zirconium alloy film and a 0.1-1 μm thick Au—Ag alloy protective film are sputtered and deposited on the porous ceramic. At this thickness, the film quality is inevitably affected by the surface roughness of the porous ceramic.

Fourth, other atomization cores: for example, CN201620757596.4, CN201810009220.9 and CN201910229470.8 disclose monocrystalline silicon-based MEMS atomization cores, which are expected to solve the problems of inconsistent atomizing temperature and flavor change caused by direct contact between the heating surface and the e-liquid. A micro-perforation plate with micro-perforation array is used to control the liquid flow. The diameter of the micro fluidic channels is 10 to 500 μm, and those of the micro-perforation channels are 500 to 1000 μm. The metal films are one or more of Ti/Pt/Au, TiW/Au, Al, Cr or Pt/Au with a thickness of 200 to 500 nm. However, the system reliability of such devices is still at stake. Another example is CN201821218626.X and CN201810855337.9, which describe an atomizer of capillary array using stainless-steel medical tubes and glass tubes with inner diameters of 0.01-0.1 mm as capillaries array. The external stainless-steel sheet is directly heated, thus similarly avoiding the contact between the heating body and e-liquid. The effective atomization area where the fluid passes through reaches up to 50%. These patents claim to have overcome the shortcomings of ceramic heating bodies, thus achieving atomized e-cigarette more authentical to traditional cigarettes. However, the processing and assembly of micro-tubes pose certain safety risks for powder and other particles to enter the aerosol.

In terms of safety, although the above four atomization methods have greatly reduced the amount of harmful ingredients compared to traditional cigarettes, there is an ongoing need for further improvements.

BRIEF SUMMARY

The present disclosure aims to overcome the weaknesses in the above-mentioned related technologies and provides an atomization core, which not only realizes safer atomization, but also allows, with precise design, dose-control atomization and uniform atomization without coking or particle emission.

For the above purposes, the atomization core disclosed by the present disclosure comprises a core substrate and a heating body on the core substrate, wherein the core substrate is made of a dense material, with perforations distributed in the core substrate adapted for allowing a liquid (or e-liquid) to be transferred from a first side to a second side of the core substrate. The diameter of the perforations is in the range of 1-250 μm, and the wall spacing between two adjacent perforations is less than 500 μm.

The dense material may comprise one of the following materials: monocrystalline or polycrystalline materials, high temperature resistant and thermal shock resistant glasses, dense ceramics, and/or other materials. Preferably, the monocrystalline materials may comprise monocrystalline alumina and monocrystalline silicon, polycrystalline silicon materials, and the like. The high temperature resistant and thermal shock resistant glasses may comprise quartz glass, borosilicate glass, or aluminosilicate glass. The dense ceramic may comprise silica, alumina, zirconia, zinc oxide, silicon carbide, diatomite, mullite, zirconite, or apatite with a relative density exceeding 70%.

Preferably, the porosity of the dense material is less than 30%; more preferably, the porosity of the dense material is less than 10%.

Preferably, the heating body is a thin film/coating or a metal heating body.

Preferably, the heating body is coated or screen printed, vapor deposited, liquid deposited or directly bonded to the core substrate.

Preferably, the thickness of the heating body is, less than 100 μm if coated or screen-printed, 5 μm or less if deposited, or less than 50 μm if bonded.

Preferably, the heating body is selected from biocompatible films such as titanium, tantalum and alloy thereof, or titanium/tantalum oxide films, or metal foils bonded with the substrate of the atomization core. Optionally, a protective passive film is further provided on the heating body as needed.

The diameter of the perforations is 150 μm or less, preferably between 25 μm and 120 μm, and more preferably 80 μm or less.

Preferably, the wall spacing between two adjacent perforations is below 250 μm, preferably below 150 μm, and more preferably below 100 μm.

Preferably, the perforations are made by extrusion molding, injection molding, compression molding, 3D printing, laser processing, or mechanical drilling.

By forming controllable fluidic channels in the substrate, the disclosed atomization core can perform not only approximately in-situ atomizing, but also accurately dose-control vaping by quantifying the fluidic channels, and also uniform atomizing by maximally controlling the nucleation and growth processes of atomized particles. More importantly, the substrate is no longer porous ceramic, and the vaping interface of the whole atomization process is very stable and safe, ceramic particle emission and other substances in the porous ceramic based atomizer are fully avoided to atomized aerosol, thereby a safer, more uniform and quantitative vaping is achieved.

DETAILED DESCRIPTION

Figure 1B:
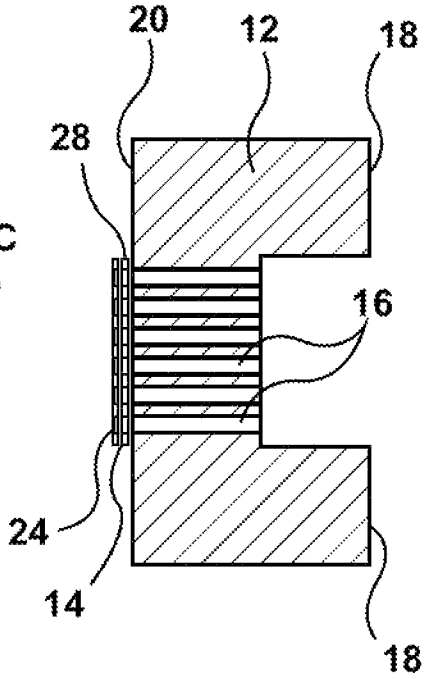
FIG. 1B is a schematic sectional view of the atomization core shown in FIG. 1*a* as viewed along lines 1B-1B in FIG. 1A.
Figure 1A:
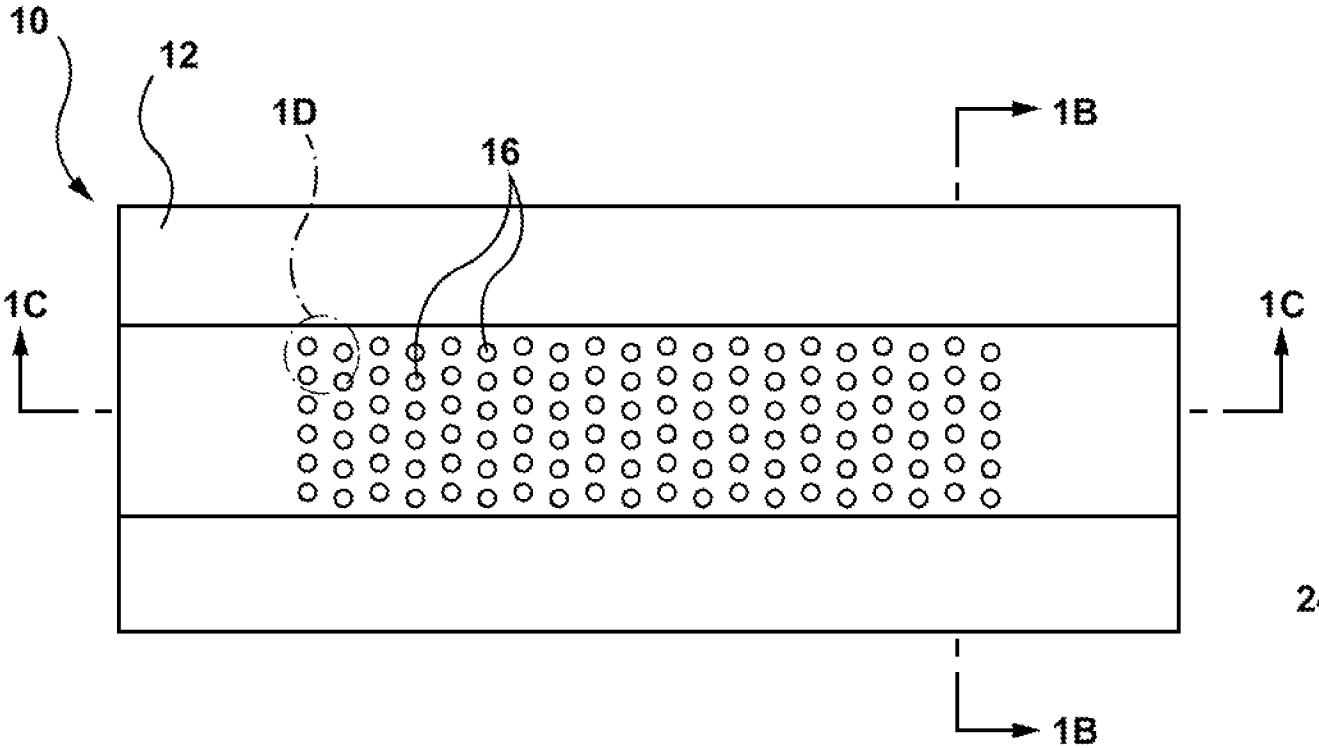
FIG. 1A is a schematic plan view of an atomization core according to Embodiment 1 of the present disclosure.
Figure 1C:
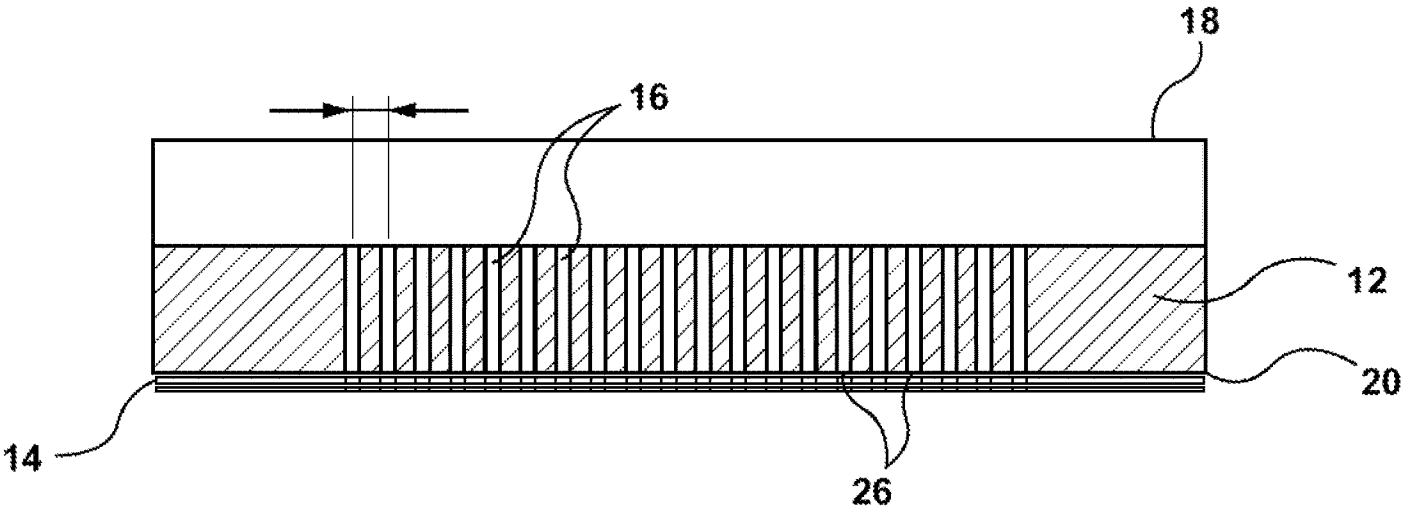
FIG. 1C is a schematic sectional view of the atomization core shown in FIG. 1*a* as viewed along lines 1C-1C in FIG. 1A.
Figure 1D:
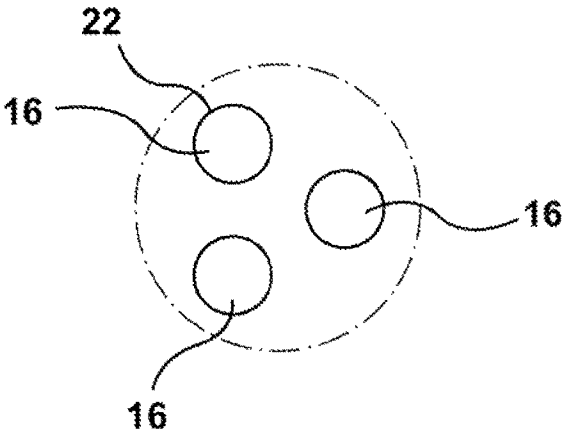
FIG. 1D is a schematic enlarged view of area 1D of the atomization core shown in FIG. 1A.

In order to make the objective, technical solutions, and advantages of the present disclosure clearer, detailed description of the present disclosure is further given below, with reference to the accompanying drawings and embodiments. Additional features and advantages of the present disclosure will be provided in part in the following description, and will be clearer in part from the following description, or may be experienced by practice of the present disclosure. It is to be understood that the following description is exemplary only and is not restrictive of the present disclosure.

The atomization core 10 disclosed by the present disclosure comprises a core substrate 12 and a heating body 14 disposed on the core substrate 12. The core substrate 12 is made of a dense material with perforations 16 defined through the core substrate 12 from a first side 18 to a second side 20. Perforations 16 are adapted for allowing a desired liquid (or e-liquid) to be transferred from the first side 18 of core substrate 12 to the second side 20 of core substrate 12 where heating body 14 is located to transform the liquid into an aerosol. Each of the perforations 16 is defined by a wall 22. Each of the perforations 16 has a diameter D in the range of 1-250 μm and a wall spacing S between two adjacent perforations 16 of less than 500 μm. The core substrate 12 has a length L, width W and thickness T. The core substrate 12 may further have a groove G defined in the first side 18 with a groove width GW and a groove height GH.

The dense material of the core substrate 12 may comprise one of the following materials: monocrystalline alumina or other monocrystalline or polycrystalline materials, high-temperature resistant and thermal shock resistant glasses, and dense ceramics. Preferably, the high temperature resistant and thermal shock resistant glasses may comprise quartz glass, borosilicate glass or aluminosilicate glass, and the dense ceramics may comprise silica, alumina, zirconia, zinc oxide, silicon carbide, diatomite, mullite, zirconite, or apatite with a relative density exceeding 70%. The porosity of the dense ceramic is less than 30%.

The heating body 14 is a thin film/coating or metal heating body, which is coated or screen printed, vapor deposited, liquid deposited, or directly bonded to the core substrate 12. The e-liquid transferring perforations 16 are made by extrusion molding, injection molding, compression molding, 3D printing, laser processing, or mechanical drilling.

In the present disclosure, the dense material of core substrate 12 and the sizes and positions of the perforations 16 are important factors for controlling the production of atomized aerosol, as the performance of the aerosol depends on precise control and uniformity of the same. The sizes of the perforations 16 are important factors for aerosol chemical compositions and particle size control, and they are also important factors to prevent coking at low temperature. According to the disclosure, the common use of porous ceramic is avoided, and the overall strength of the atomization core material is greatly improved, thereby emissions of ceramic particles into the aerosol and associated damage to the lungs are avoided.

The atomization core 10 of the present disclosure overcomes the disadvantages of currently used porous ceramics, including uncontrollable porosity, uneven pore sizes and distribution, rough surface, inconsistent atomizing interface caused by grain boundary segregation in the preparation of porous ceramics. With the understanding of the atomizing mechanism and the atomizing interface, the mechanism of uniform and quantitative atomization is established, and thereby both the particles size distributions and chemical components of the atomized aerosol are improved. Consequently, the taste/flavor authentic, taste consistency from first puff to last puff, and the taste satisfactions are greatly improved. In addition, the size and the number of the perforations 16 of the present disclosure may be tailored according to the characteristics of the liquid. Thus some disadvantages in the conventional porous ceramic based coils are fully avoided such as low temperature coking of some ingredients in the liquid because of the mismatch between pore size and certain chemical ingredients. Thanks to the control of vaping interface and mechanism, some chemical reaction and thermal decomposition in the atomization process are greatly inhibited. Thus the HPHC (harmful and potential harmful constituents) and heavy metals in the aerosol are greatly reduced. Furthermore, the ceramic particle emission is also fully eliminated.

Preferably, the porosity of the dense material for the core substrate 12 of the present disclosure is less than 10%; the thickness of the heating body 14 is less than 100 μm if coated or screen-printed, 5 μm or less if vapor deposited, or less than 50 μm if bonded.

Preferably, the heating body 14 of the present disclosure is selected from biocompatible materials such as titanium, tantalum et al, or alloys thereof, or titanium/tantalum oxide films, or metal foils bonded with the core substrate 12. The heating body 14 may also be other heat-resistant conductive compounds or mixture films. A protective passive film 24 may be further provided on the heating body 14 as needed.

The diameter D of the perforations 16 are 150 μm or less, preferably between 25 μm and 120 μm, and more preferably 80 μm or less.

Preferably, the wall spacing S between two adjacent perforations 16 is below 250 μm, preferably below 150 μm, and more preferably below 100 μm.

In the present disclosure, thanks to the control of the fluidic channels and in-situ heating, the atomization nucleation and the dynamic growth after nucleation are more accurately controlled, so that the particle size and composition, quantity/volume and temperature of the atomized aerosol may be controlled or tailored according to specific atomization requirements, and the liquid transmission efficiency can be improved to a certain extent. The outlet 26 of each perforation 16 allows for the origination of atomization nucleation. Liquid will spread from the outlet 26 of each perforation 16 onto the heating surface 28 of the heating body 14. The wall spacing S between the two adjacent perforations 16 is preferably below 250 μm, which will greatly mitigate the risks that the liquid fails to completely cover the heating surface 28, or will not affect the liquid from covering the heating surface 28 in the atomization process, thus either dry burning or local over-high temperature is fully avoided. Hence in-situ atomization or in-situ vaping can be defined in the present disclosure. At present, the vast majority of atomizing devices employs ex-situ heating through heat conduction, resulting in uneven temperatures, which is also the main reason why HPHC cannot be completely eliminated.

Technical features involved in various embodiments of the present disclosure can be combined with each other as long as they do not conflict with each other.

Embodiment 1

The core substrate 12 is made of monocrystalline alumina. The core substrate 12 has a length L of 9.00±0.1 mm, width W of 3.60±0.1 mm, thickness T of 2.00±0.1 mm, groove width GW of 1.60±0.1 mm and groove height GH of 0.90±0.1 mm. Perforations 16 are spaced inwards from each end of core substrate 12 by a distance of 1.60±0.1 mm and the center axes of adjacent perforations 16 are spaced by 0.30 mm. After processing of core substrate 12 by computer numerical control (CNC) machining into its shape and dimensions, a zoom laser is employed to form an array of perforations 16 between first side 18 and second side 20. Perforations have diameter D of, for example, 120 μm, 100 μm, 80 μm, or 60 μm, and wall spacing S between two adjacent perforations 16 of, for example, 250 μm, 200 μm, 150 μm, or 100 μm, respectively. The array of perforations 16 can be a close-packed triangular or rectangular shape or other shapes. After that, a titanium or tantalum oxide film (4.5 μm titanium oxide film in FIGS. 1A-1D) with a thickness ranging from 0.35 μm to 5 μm is deposited on second side 20 by sputtering or electron beam evaporation to form heating body 14. And the thickness is directly related to the oxygen content in the thin film. As to different oxygen content in the thin films or thin films with low oxygen content, a passive film 24 is further deposited thereon, such as an Au film with about 12 nm thickness (as shown in FIGS. 1A-1D). Then electrodes are formed with safe conductive paste on both ends of the core substrate 12 and connected to the battery. The thickness of each film for heating body 14 and passive film 24 depends on the design of the resistance and atomization power. The film for heating body 14 deposited between the perforation walls 22 provides a uniform temperature field and a uniform nucleation center, and forms controllable liquid fluidic and air fluidic channels during atomization. Consequently the volume and the properties of the atomized aerosol are well controlled to achieve better nicotine delivery efficiency and various aerosol satisfactions. The uniform temperature field is a result of the design of heating element of the heating body 14, e.g., the design of screen-printed coating or deposited film or metal foil, which is directly controlled by the uniformity of wall spacing S. The non-porous areas are the heating surface 28, and the controllable liquid and air flow refer to the control of the fluidic channels and the interface of atomization nucleation. For different kinds of e-liquids and other liquids, uniform atomization is achieved without coking or ceramic particle emission. FIGS. 1A-1D show one example.

Embodiment 2

Figure 2B:
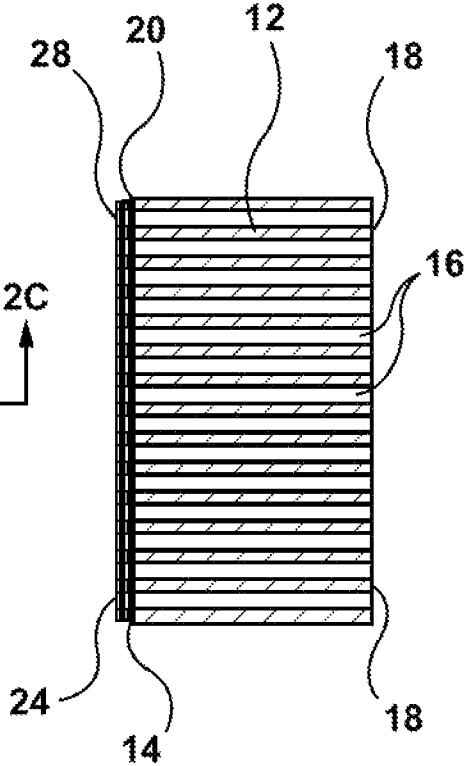
FIG. 2B is a schematic sectional view of the atomization core shown in FIG. 2A as viewed along lines 2B-2B in FIG. 2A.
Figure 2A:
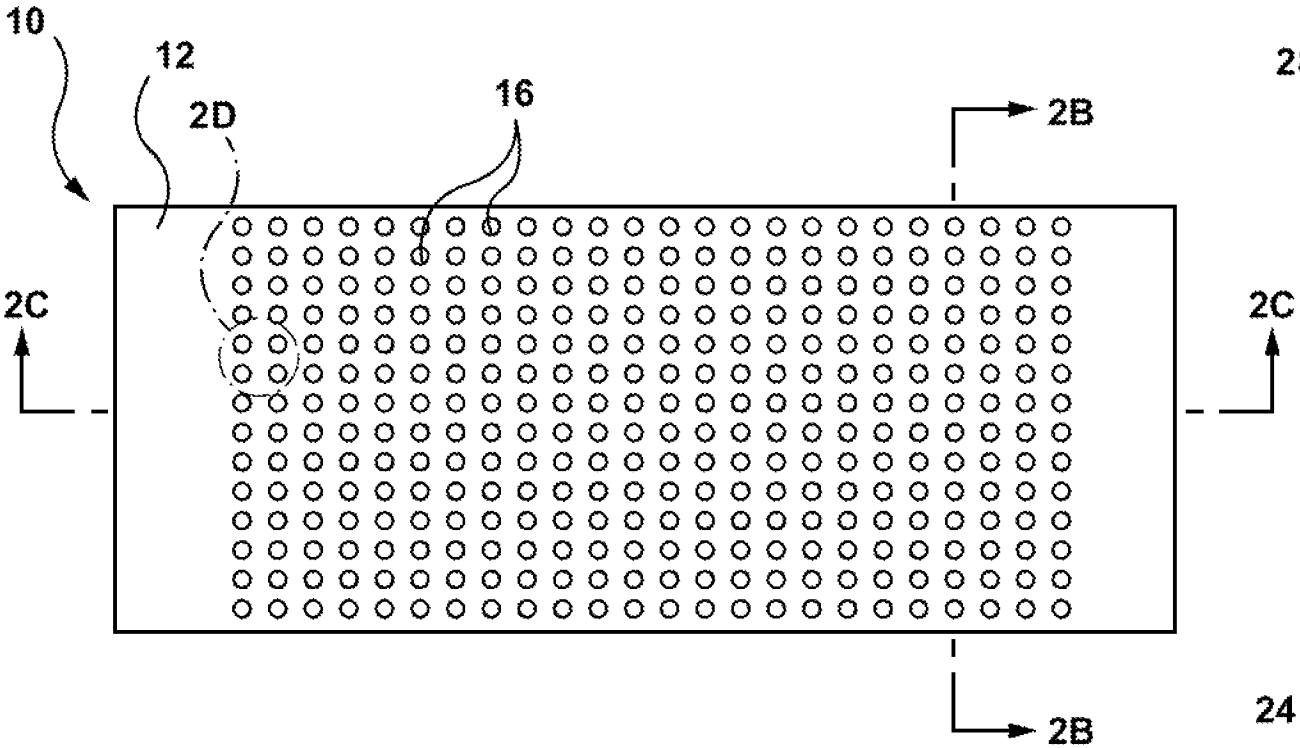
FIG. 2A is a schematic plan view of an atomization core according to Embodiment 2 of the present disclosure.
Figure 2C:
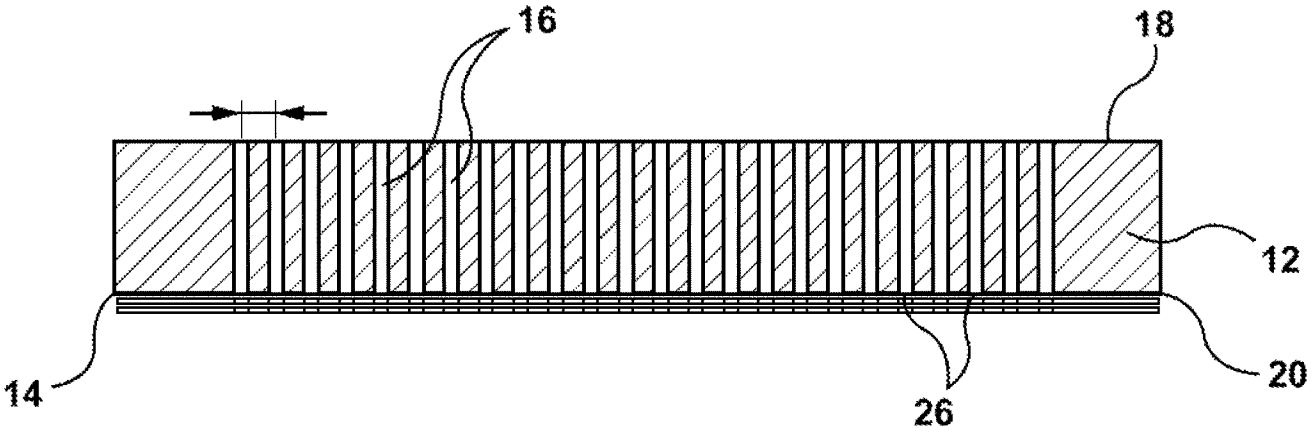
FIG. 2C is a schematic side sectional view of the atomization core shown in FIG. 2A as viewed along lines 2C-2C in FIG. 2A.
Figure 2E:
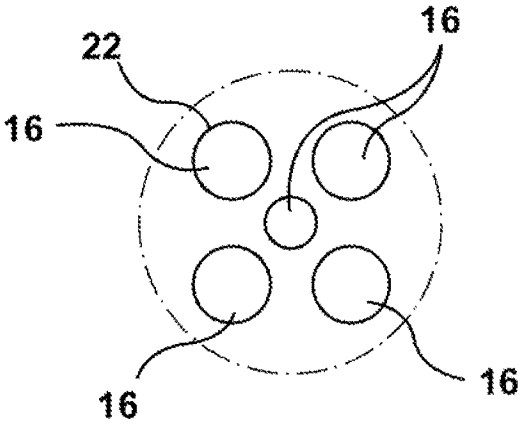
FIG. 2E is a schematic enlarged view of a different arrangement of perforations for the atomization core shown in FIG. 2A.
Figure 2D:
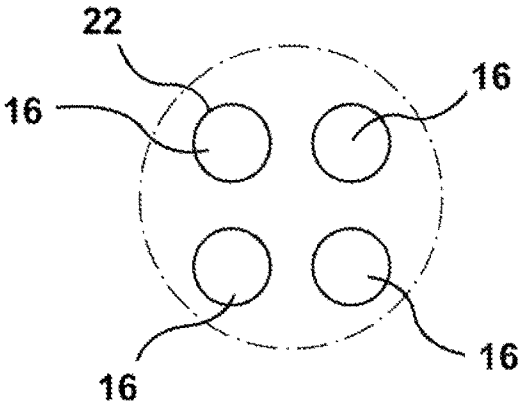
FIG. 2D is a schematic enlarged view of area 2D of the atomization core shown in FIG. 2A.
Figure 3B:
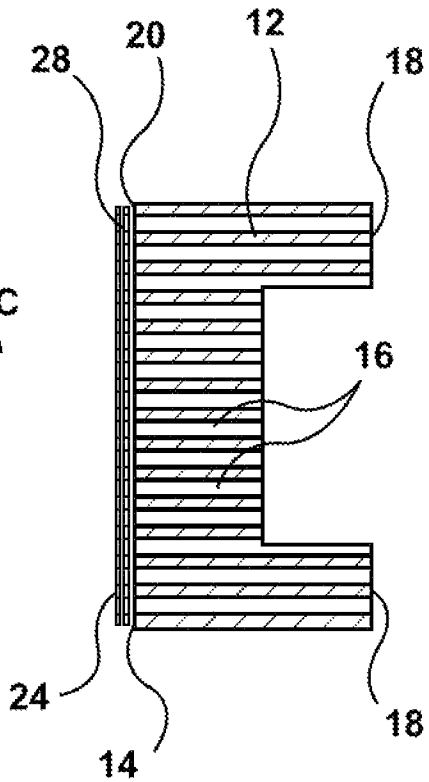
FIG. 3B is a schematic sectional view of the atomization core shown in FIG. 3A as viewed along lines 3B-3B in FIG. 1A.
Figure 3A:
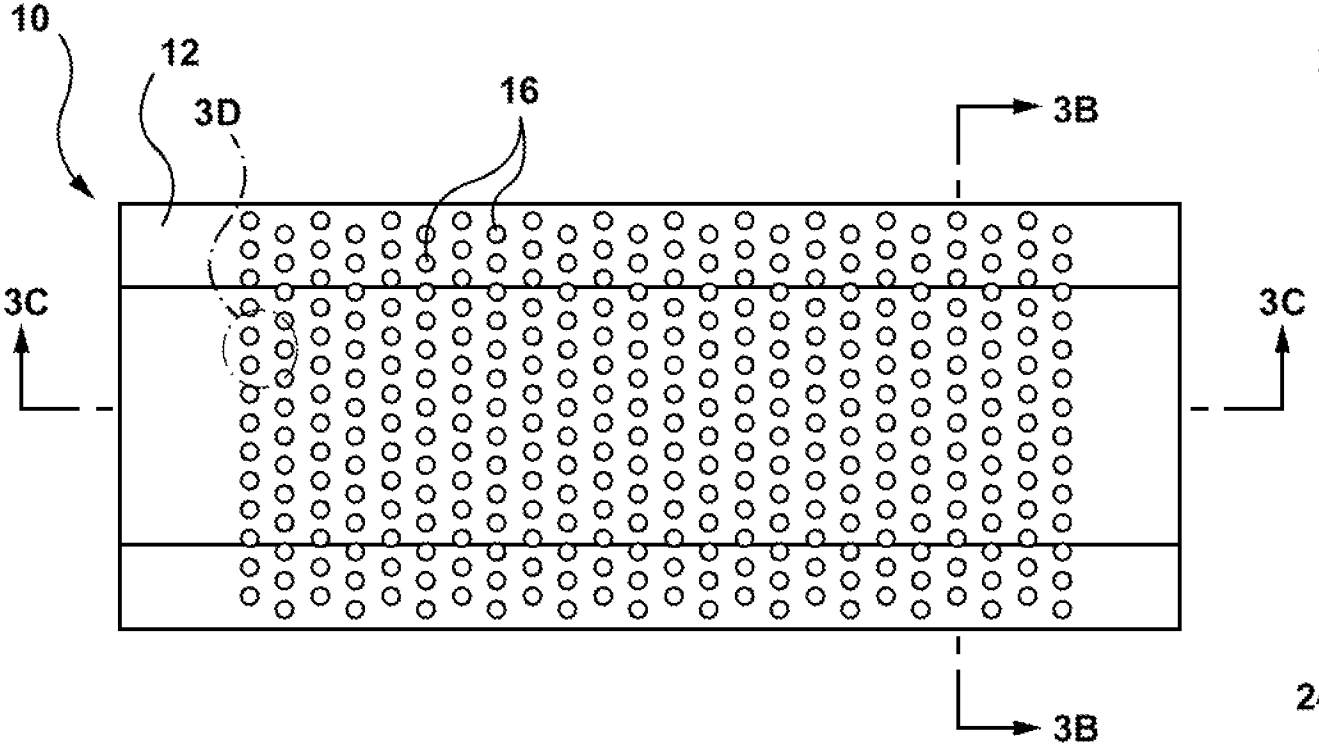
FIG. 3A is a schematic plan view of an atomization core according to Embodiment 4 of the present disclosure.
Figure 3C:
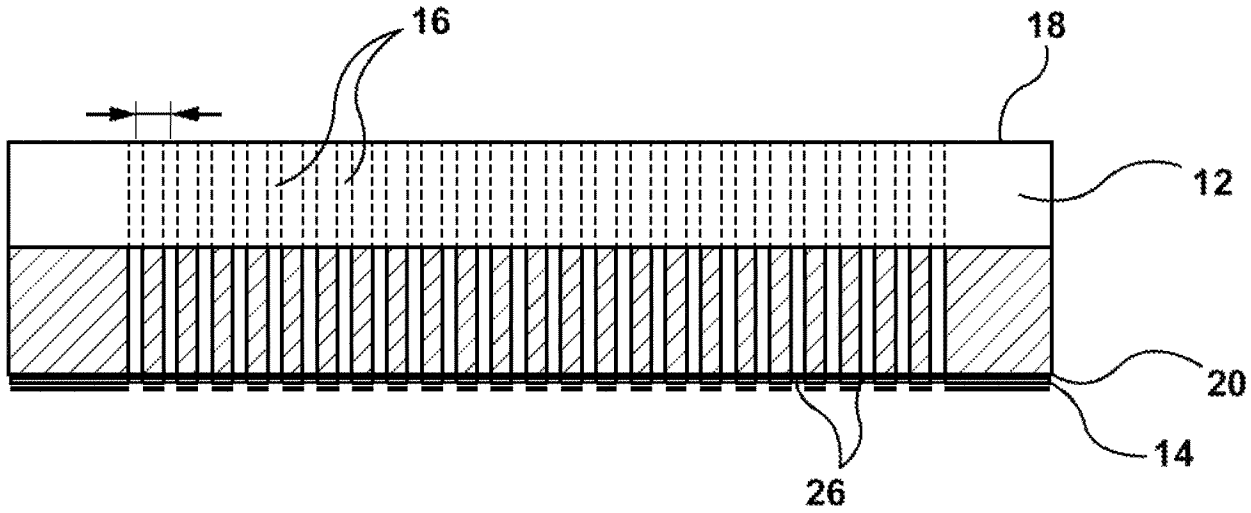
FIG. 3C is a schematic side sectional view of the atomization core shown in FIG. 3A as viewed along lines 3C-3C in FIG. 3A.
Figure 3D:
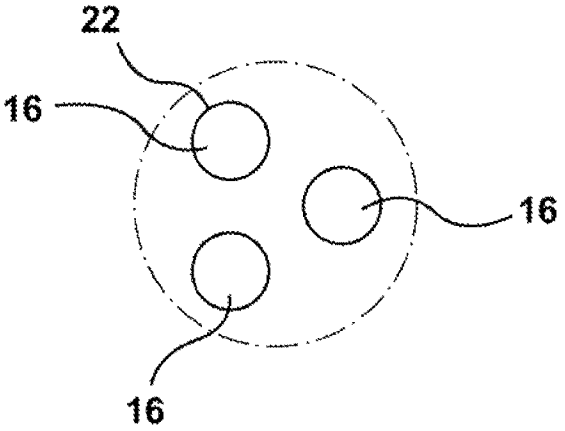
FIG. 3D is a schematic enlarged view of area 3D of the atomization core shown in FIG. 3A.

The core substrate 12 is made of monocrystalline alumina. The core substrate 12 has a length L of 9.00±0.1 mm, width W of 3.60±0.1 mm and thickness T of 1.10±0.1 mm. Perforations 16 are spaced inwards from each end of core substrate 12 and the center axes of adjacent perforations 16 are spaced by 0.25 mm. After processing core substrate 12 by CNC machining into its shape and dimensions, a zoom laser is employed to form an array of perforations 16 between first side 18 and second side 20. Perforations have diameter D of 100 μm and a wall spacing S between two adjacent perforations 16 of 200 μm. The array of perforations 16 can be arranged in a close-packed triangular or rectangular shape or other shapes. In some examples, as shown in FIG. 2E, a perforation 16 with a smaller diameter may be located between a group of four larger perforations 16. After that, a titanium or tantalum oxide film (4 μm titanium oxide film in FIGS. 2A-2E) with a thickness ranging from 0.35 μm to 5 μm is deposited by sputtering or electron beam evaporation to form heating body 14. As the thickness is directly related to the oxygen content in the thin film. As to different oxygen content in the thin films or thin films with low oxygen content, a passive film 24 is further deposited thereon, such as an Au film with a thickness of about 15 nm (as shown in FIGS. 2A-2E). Then electrodes are formed with safe conductive paste on both ends of the core substrate 12 and connected to the battery. The thickness of each film 14 and 24 depends on the resistance and atomization power required. The film forming heating body 14 deposited between the perforation walls 22 forms a uniform temperature field and a uniform nucleation center, and forms controllable fluid fluidic and air fluidic channels during atomization. Consequently the volume and the properties of the atomized aerosol are well controlled to achieve better nicotine delivery efficiency and various aerosol satisfactions. The uniform temperature field is resulted from the design of heating element of the heating body 14, e.g., the design of screen-printed coating or deposited film or metal foil, which is directly controlled by the uniformity of wall spacing S. The non-porous areas are the heating surface 28, and the controllable liquid and air flow refer to the control of the fluidic channels and the interface of atomization nucleation. For different kinds of e-liquids and other liquids, uniform atomization is achieved without coking, ceramic particle emission or any heavy metals.

Embodiment 3

The core substrate 12 is made of transparent quartz glass. After processing of core substrate 12 by CNC machining into its shape and dimensions, a zoom laser is employed to form an array of perforations 16 between first side 18 and second side 20. Perforations have diameters D of 120 μm and 80 μm, and wall spacing S controlled at 200 μm and 150 μm, respectively. The array of perforations 16 is arranged in a close-packed triangular shape, or can be arranged in a close-packed rectangular shape or other shapes. After that, a titanium or tantalum oxide film with a thickness ranging from 0.35 μm to 5 μm is formed by sputtering or electron beam evaporation to form heating body 14. The thickness is directly related to the oxygen content in the thin film. As to different oxygen content in the thin films or thin films with low oxygen content, a passive film 24 is further deposited thereon, such as an Au film with a thickness of about 15 nm. Then electrodes are formed with safe conductive paste on both ends of the core substrate 12 and connected to the battery. The thickness of each film 14 and 24 depends on the resistance and atomization power required. The film forming heating body 14 deposited between the perforation walls 22 forms a uniform temperature field and a uniform nucleation center, and forms controllable liquid fluidic and air fluidic channels during atomization. Consequently the volume and the properties of the atomized aerosol are well controlled to achieve better liquid delivery efficiency and various aerosol satisfactions. The uniform temperature field is resulted from the design of heating body 14, i.e., the design of deposited film or metal foil, which is directly controlled by the uniformity of wall spacing S. The non-porous areas are the heating surface 28, and the controllable liquid and air flow refer to the control of the fluidic channels and the interface of atomization nucleation. For different kinds of e-liquids and other liquids, uniform atomization is achieved without coking or ceramic particle emission.

Embodiment 4

The core substrate 12 is dense zirconia ceramic, prepared by 3D printing. The core substrate 12 has a length L of 9.00±0.1 mm, width W of 3.60±0.1 mm, thickness T of 2.00±0.1 mm, groove width GW of 2.20±0.1 mm and groove height GH of 0.90±0.1 mm. Perforations 16 are spaced inwards from each end of core substrate 12 and the center axes of adjacent perforations are spaced by 0.30 mm. The array of perforations 16 is also formed in the 3D printing process. The perforation diameters D are 120 μm and 100 μm respectively, and the wall spacing S between two adjacent perforations 16 is controlled at 180 μm. The array of perforations 16 is arranged in a close-packed triangular shape. After that, a titanium or tantalum oxide film with a thickness ranging from 0.35 μm to 5 μm is deposited by sputtering or electron beam evaporation to form heating body 14 (4 μm titanium oxide film in FIGS. 3A-3D). The thickness is directly related to the oxygen content in the film. As to different oxygen content in the thin films or thin films with low oxygen content, a passive film 24 is further deposited thereon, such as an Au film with a thickness of about 15 nm. Then electrodes are formed with safe conductive paste on both ends of the core substrate and connected to the battery. The thickness of each film 14 and 24 depends on the resistance and atomization power required. The film forming heating body 14 deposited between the perforation walls 22 forms a uniform temperature field and a uniform nucleation center, and forms controllable liquid fluidic and air fluidic channels during atomization. Consequently the volume and the properties of the atomized aerosol are well controlled to achieve better nicotine delivery efficiency and various aerosol satisfactions. The uniform temperature field is resulted from the design of heating body 14, i.e. the design of deposited film or metal foil, which is directly controlled by the uniformity of wall spacing S. The non-porous areas are the heating surface 28, and the controllable liquid and air flow refer to the control of the fluidic channels and the interface of atomization nucleation. For different kinds of e-liquids and other liquids, uniform atomization is achieved without coking or ceramic particle emission.

The atomization core 10 disclosed by the present disclosure can be used not only for e-cigarettes, but also for medical atomization (e.g. atomizer/nebulizer for pain relief and asthma relief) and entertainment atomization.

A person skilled in the art can easily understand that the foregoing descriptions are merely preferred embodiments of the present disclosure, but are not intended to limit the present disclosure. Any modifications, equivalent replacements, or improvements made within the spirit and principle of the present disclosure shall fall within the protection scope of the present disclosure.

What is claimed is:

1. An atomization core comprising:

a core substrate having a porosity of less than 10%, the core substrate having a first side and a second side;

a plurality of perforations defined in the core substrate, the perforations extending from the first side to the second side of the core substrate, each of the perforations having a wall, the perforations being arranged in an array having a triangular shape and uniformly dispersed over a substantial portion of the core substrate;

a heating body disposed on the second side of the core substrate between the walls of the perforations to form fluidic channels for atomizing a liquid transferred through the perforations; and electrodes electrically connected across a width of the heating body at opposing ends.

2. The atomization core according to claim 1, wherein the plurality of perforations have a uniform diameter.

3. The atomization core according to claim 1, wherein the plurality of perforations have a uniform spacing between the walls of adjacent perforations.

4. The atomization core according to claim 1, wherein the core substrate has a uniform thickness between the first side and the second side.

5. The atomization core according to claim 1, wherein the heating body has a uniform thickness.

6. The atomization core according to claim 1, wherein the plurality of perforations extend orthogonally between the first side and the second side.

7. The atomization core according to claim 1, wherein each of the perforations has a diameter of 250 μm or less.

8. The atomization core according to claim 1, wherein the walls of adjacent perforations are spaced by a distance of less than 250 μm.

9. The atomization core according to claim 1 wherein the heating body has a thickness of less than 100 μm.

10. The atomization core according to claim 1, further comprising a passive film disposed on the heating body.

11. The atomization core of claim 10, wherein the passive film comprises Au.

12. The atomization core according to claim 1, wherein the core substrate is made from a monocrystalline material.

13. The atomization core according to claim 1, wherein the core substrate is made from a high temperature resistant and thermal shock resistant glass.

14. The atomization core of claim 13, wherein the high temperature resistant and thermal shock resistant glass comprises quartz.

15. The atomization core according to claim 1, wherein the heating body comprises biocompatible films.

16. The atomization core of claim 1, wherein the fluidic channels have the same diameter as the perforations.

17. The atomization core according to claim 1, wherein the perforations are uniformly spaced from one another both linearly and diagonally in the triangular array.

18. The atomization core according to claim 1, wherein the plurality of perforations are defined by laser in the core substrate.

19. An atomization core comprising:

a core substrate having a porosity of less than 10% and a first side and a second side;

a plurality of perforations defined in the core substrate, the perforations extending from the first side to the second side, each of the plurality of perforations having a wall, wherein the plurality of perforations have a uniform diameter, and wherein the plurality of perforations are arranged in an array having a triangular shape and uniformly dispersed over a substantial portion of the core substrate;

a heating body having a uniform thickness disposed on the second side of the core substrate between the walls of the perforations to form fluidic channels for atomizing a liquid transferred through the perforations; and electrodes electrically connected across a width of the heating body at opposing ends.

20. An atomization device comprising:

an atomization core having:

a core substrate having a porosity of less than 10%, the core substrate having a first side and a second side;

a plurality of perforations defined in the core substrate, the perforations extending from the first side to the second side of the core substrate, each of the perforations having a wall, the perforations being arranged in an array having a triangular shape and uniformly dispersed over a substantial portion of the core substrate;

a heating body disposed on the second side of the core substrate between the walls of the perforations to form fluidic channels for atomizing a liquid transferred through the perforations; and electrodes connected across a width of the heating body at opposing ends for electrically connecting the heating body to a power supply, wherein the plurality of perforations have a size that is matched to the liquid for atomizing.

* * * * *